US008490676B2

(12) United States Patent
Shibata et al.

(10) Patent No.: US 8,490,676 B2
(45) Date of Patent: Jul. 23, 2013

(54) MULTI-CAVITY MOLD

(75) Inventors: Kiyoshi Shibata, Tokyo (JP); Hideo Hazekawa, Tokyo (JP); Keizou Tanoue, Tokyo (JP); Masamitsu Yamashita, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/919,960

(22) PCT Filed: Feb. 18, 2009

(86) PCT No.: PCT/JP2009/052784

§ 371 (c)(1),
(2), (4) Date: Aug. 27, 2010

(87) PCT Pub. No.: WO2009/113370

PCT Pub. Date: Sep. 17, 2009

(65) Prior Publication Data

US 2011/0011553 A1 Jan. 20, 2011

(30) Foreign Application Priority Data

Mar. 12, 2008 (JP) ..... 2008-063021

(51) Int. Cl.
*B22D 17/22* (2006.01)
*B22C 9/08* (2006.01)

(52) U.S. Cl.
USPC ..... 164/312; 164/337; 164/358; 164/113

(58) Field of Classification Search
USPC ..... 164/113, 133–135, 312, 337, 358
See application file for complete search history.

(56) References Cited

U.S. PATENT DOCUMENTS 4,955,424 A * 9/1990 Takehisa et al. ..... 164/72
6,698,496 B2 * 3/2004 Takayama et al. ..... 164/312

FOREIGN PATENT DOCUMENTS

| | | | |
|---|---|---|---|
| JP | 63144852 | | 6/1988 |
| JP | 01034554 | | 2/1989 |
| JP | 03193255 | | 8/1991 |
| JP | 03294056 | A * | 12/1991 |
| JP | 2002035916 | A * | 2/2002 |
| JP | 2005059044 | | 3/2005 |
| JP | 2005074445 | A * | 3/2005 |
| JP | 2006239738 | A * | 9/2006 |
| JP | 2007038513 | A * | 2/2007 |

OTHER PUBLICATIONS

JPO machine translation of JP 2002035916 A, Feb. 5, 2002.*
JPO machine translation of JP 2005-059044 A, Mar. 10, 2005.*

(Continued)

*Primary Examiner* — Kevin P Kerns
*Assistant Examiner* — Kevin E Yoon
(74) *Attorney, Agent, or Firm* — Rankin, Hill & Clark LLP

(57) ABSTRACT

Four cavities are arranged on a concentric circle "C" with respect to the center "O" of a flow divider and a gate sleeve. Each of the cavities is connected to a sleeve stamp portion through each of four die side runners and each of four stamp side runners formed in a radial direction and separated from the neighboring runners. A semicircular arc-shaped reservoir is provided between the lower half side of the flow divider and the lower half side of the gate sleeve. This reservoir is connected to the sleeve stamp portion. A semi-solidified layer formed by pouring the molten metal into a sleeve is filled into the reservoir, so that the molten metal from which the semi-solidified layer is separated can be filled directly from each of the stamp side runners via the die side runners into each of the cavities evenly and simultaneously.

8 Claims, 9 Drawing Sheets

OTHER PUBLICATIONS

JPO machine translation of JP 2005074445 A, Mar. 24, 2005.*
JPO machine translation of JP 2007038513 A, Feb. 15, 2007.*
JPO machine translation of JP 2006-239738 A, Sep. 14, 2006.*

* cited by examiner

MULTI-CAVITY MOLD

BACKGROUND OF THE INVENTION

1. Field of the Invention

The present invention relates to a multi-cavity mold for use in an aluminum die cast molding or the like.

2. Description of the Related Art

In a multi-cavity mold, it is necessary to have the quality stabilized between products. As one of the causes of quality variation in the products, there is a difference in filling time of a molten metal between cavities for each of the products. Therefore, if the molten metal is filled simultaneously into the cavities of each of the products, the quality may be stabilized. In this point of view, there is the art that the cavities of each of the products are arranged substantially in the shape of a sector form with respect to a sleeve (see a patent reference 1).

Further, when the molten metal is filled into the sleeve, a portion of the molten metal which contacts a low temperature inner wall of the sleeve is rapidly cooled thereby forming a chill (quenching organization). At the same time, an oxide film is formed on a surface of the molten metal. These solidification layer and oxide film are mixed with a liquid molten metal so as to form a semi-solidified layer thereby giving rise to deterioration in liquidity and to deterioration in pressure transfer property. When a gate portion is filled with the semi-solidified metal, the run of the molten metal is inhibited so as to cause the poor run of the molten metal, and then the injection pressure is increased so as to produce the burr and to shorten the life of the mold. Further, this semi-solidified layer is greatly different in organization from other portion of the molten metal. Therefore, when an oxide substance and a broken chill each of which forms a portion of the semi-solidified layer are included in the product, quality deficiencies such as faulty in thickness by contamination of a foreign substance with respect to the casting product, separation of the chilled layer after machining of the casting product and the like may be developed. In this point of view, the art that a reservoir is provided around a flow divider for preventing penetration of the oxide substance and the broken chill into the product is publicly known (see patent references 2 and 3).

Patent reference 1: Japanese patent laid-open publication No. S64-34554A.

Patent reference 2: Japanese patent laid-open publication No. S63-144852A.

Patent reference 3: Japanese patent laid-open publication No. 2005-59044A.

In the multi-cavity mold, it is necessary to fill the molten metal uniformly and simultaneously into each of product forming sections. Moreover, it is necessary to prevent the penetration of the oxide substance and the broken chill into each of the products.

Further, in the case of mass production, a die temperature is low in an initial number of casting times (shots) and reaches a predetermined temperature by repeating shots several times, whereby the quality of the product is stabilized. In this case, the products before reaching the predetermined temperature are defective. However, because of the multi-cavity mold, the number of defective products becomes greater as the number of defective shots increases, so that it is desirable to reduce the number of such defective shots. Therefore, the present invention aims to make it possible to supply the molten metal of little impurities and good flowability so as to materialize the above mentioned various requirements.

SUMMARY OF THE INVENTION

To solve the above mentioned problems, the present invention according to claim 1 is directed to a multi-cavity mold in which a molten metal is filled from a sleeve through a runner into preformed cavities for a plurality of products, comprising the plurality of cavities being arranged in the shape of a sector form on a concentric circle when viewed in an axial direction of the sleeve, and runners being connected to each of the cavities to supply the molten metal simultaneously to each of the cavities, wherein the runners are arranged separate from each other and extend radially from a sleeve stamp portion, and an end of each of the runners directly faces the sleeve stamp portion.

The invention of claim 2 is directed to the multi-cavity mold according to claim 1, further comprising a gate sleeve being connected to an end of the sleeve, and a flow divider being engaged with the inside of the gate sleeve while leaving a clearance around the periphery thereof, wherein the clearance between the periphery of the flow divider and the gate sleeve is divided in a circumferential direction of the flow divider so as to form the plurality of runners.

The invention of claim 3 is directed to the multi-cavity mold according to claim 2 wherein the runners are provided in an upper half region of the clearance formed between the periphery of the flow divider and the gate sleeve while a groove shaped reservoir is provided in a lower half region of the clearance such that a semi-solidified layer formed within the sleeve is stored in the reservoir.

Since each of product forming sections is arranged in the shape of a sector form with respect to the sleeve such that the molten metal reaches simultaneously the product forming sections from the separate runners each of which extends radially from the sleeve stamped section, the molten metal may be uniformly and simultaneously filled into each of the product forming sections so as to make the quality of each of the products uniform, whereby the multi product forming of a good yield rate may be carried out.

Further, since the clearance provided between the periphery of the flow divider and the gate sleeve is divided in the circumferential direction of the flow divider so as to form the plurality of runners, the plurality of separate runners may be easily formed.

Further, the runners are provided in the upper half region of the clearance formed between the periphery of the flow divider and the gate sleeve while the groove shaped reservoir is provided in the lower half region of the clearance such that the semi-solidified layer such as a chill and an oxide substance or the like is stored in the reservoir. Therefore, the molten metal from which the foreign matter such as the broken chill and the oxide substance or the like is removed is supplied directly to each of the cavities from the sleeve stamp section, whereby the molten metal of comparatively high temperature may be supplied in a good flowable condition. Thus, the run of molten metal becomes better thereby to improve moldability.

Furthermore, since the die temperature is raised at an early stage by the arrangement of the reservoir, the preheat casting may be shortened or omitted, and a frequency of occurrence of waste spray (defective piece) may be reduced. As a result, yields in the multi-cavity mold may be brought up so as to improve the mass productivity.

Moreover, when each of the runners and the reservoir are separated in upward and downward directions, each of the runners is located fully remote from the reservoir in such a manner as to prevent penetration of the foreign matter such as the broken chill and the oxide substance or the like, whereby the quality of the molded product may be stabilized and improved.

DETAILED DESCRIPTION OF THE PREFERRED EMBODIMENT

Figure 1:
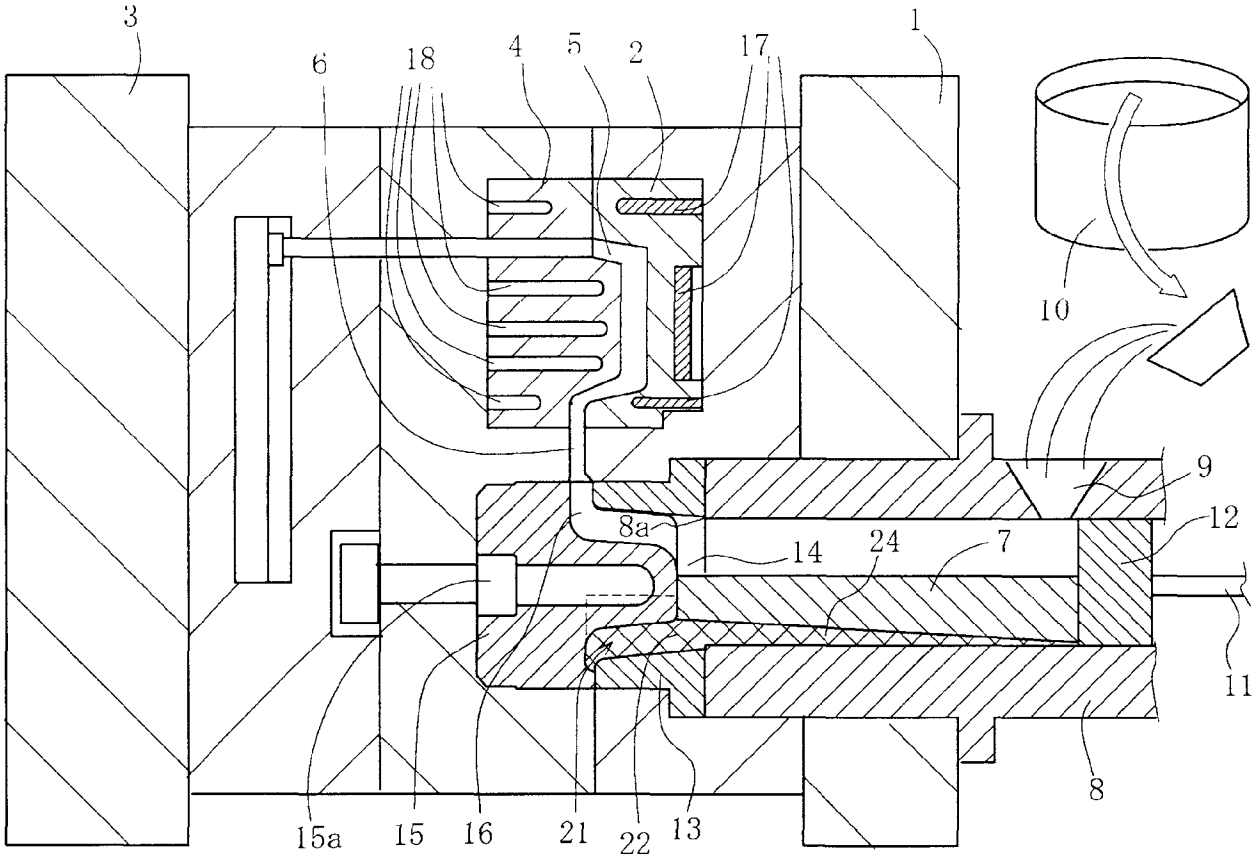
FIG. 1 is a schematic cross sectional view of an aluminum die cast molding apparatus in relation to an embodiment of the present invention.

Embodiments of the present invention will be explained hereunder with reference to accompanying drawings. FIG. 1 is a schematic cross sectional view of an aluminum die cast molding apparatus in accordance with an embodiment of the present invention. On a fixed base 1 there is provided a fixed die 2, while on a movable base 3 there is provided a movable die 4. When a mold is clamped by having the movable die 4 moved forward to the fixed die 2, a cavity 5 is formed between both of these dies. A molten metal 7 is supplied through a die side runner 6 into the cavity 5. The molten metal 7 is poured from a pouring gate 9 of a sleeve 8 into the sleeve 8. For this molten metal pouring, the molten metal which is kept for example at 680° C. in a heat reserving furnace 10 is used.

A plunger tip 12 which moves forward and backward through a plunger 11 in an axial direction of the sleeve 8 is provided within the sleeve 8. When the plunger tip 12 is moved forward to a gate sleeve 13, the molten metal 7 is injected from a forward end of the sleeve 8 to the gate sleeve 13.

The gate sleeve 13 is fixedly engaged with the fixed die 2. A forward end of the gate sleeve 13 is engaged with a flow divider 15 in such a fashion that a sleeve stamp portion 14 is formed on the inner side of the gate sleeve 13. The flow divider 15 projects into the sleeve 8 thereby to form a stamp side runner 16 between a periphery of the flow divider 15 and the gate sleeve 13. The die side runner 6 and the stamp side runner 16 constitute a runner.

The molten metal 7 injected from the sleeve 8 passes through the sleeve stamp portion 14, the stamp side runner 16 and the die side runner 6 so as to be filled into the cavity 5. By the way, the cavity 5 and the die side runner 6 are provided each in the plural number to meet a multi-cavity, as described later.

The fixed die 2 is a concaved die and has a molding concave section which forms the cavity 5. A plurality of adiabatic grooves 17 are formed in the thickness of the fixed die 2 which surrounds the molding concave section, so as to be filled with a proper heat insulating material. By the way, the adiabatic grooves 17 may be provided in the shape of adiabatic bores. Moreover, an air layer may be used instead of the heat insulating material. On the other hand, the movable die 4 is a convex die. A plurality of cooling bores 18 are provided in the thickness of the movable die 4 which forms a molding convex section, and some of the cooling bores 18 extend in such a manner as to be located close to the inside of the molding convex section.

Inventors of the present invention obtained such knowledge that the quality of the products are stabilized when die temperatures at the time of molding, of the fixed die 2 and the movable die 4 are made uniform, respectively. Therefore, based on this knowledge, the heat insulating grooves 17 are provided in the fixed die 2 which has a tendency to being low in die temperature, so as to prevent lowering of the die temperature, while the cooling bores 18 are provided in the movable die 4 which has a tendency to being high in die temperature, so as to be used for heat radiation in order for facilitating the cooling, whereby the die temperatures of the fixed die 2 and the movable die 4 can be made uniform.

Figure 2:
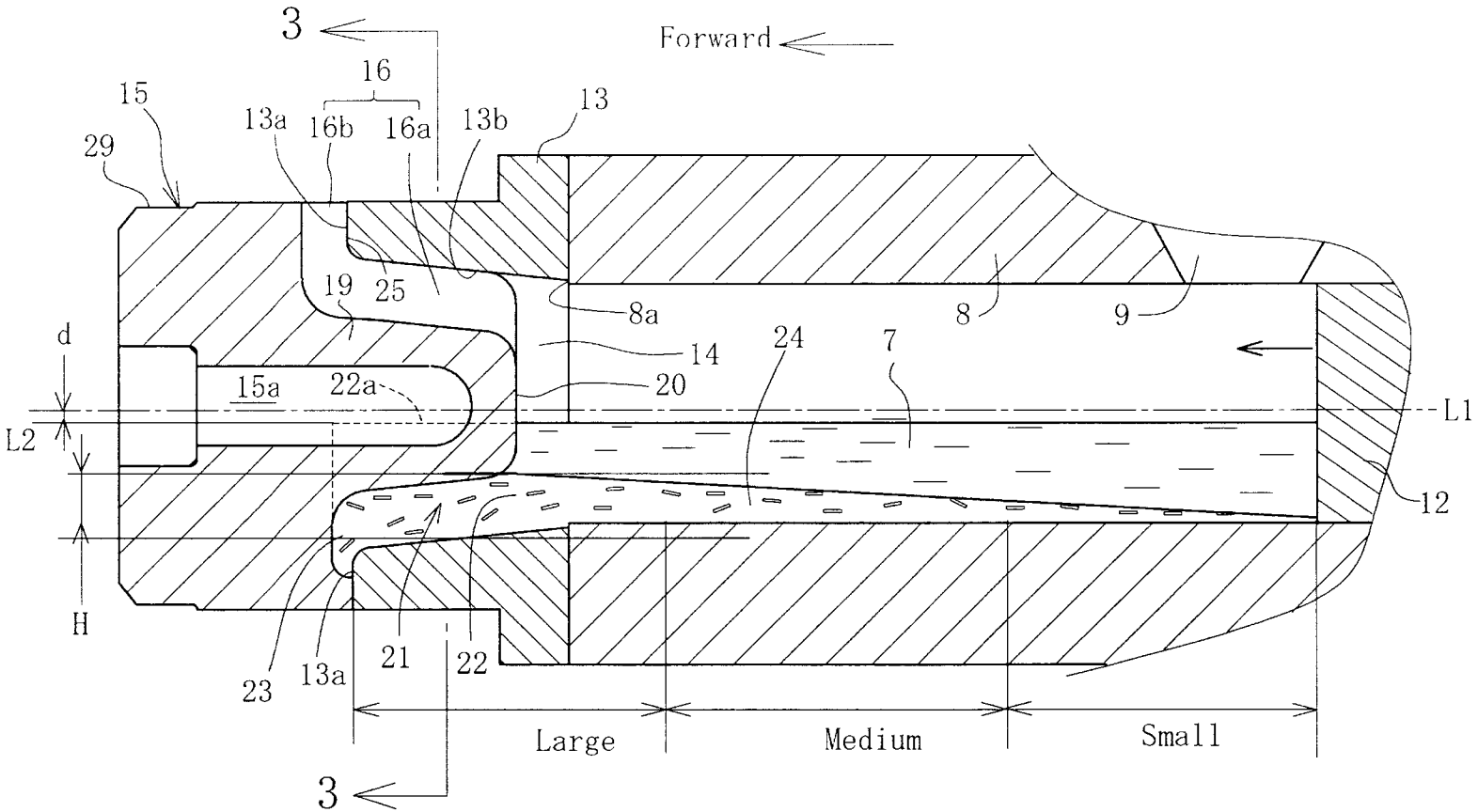
FIG. 2 is an enlarged cross sectional view showing an essential part.

FIG. 2 is a schematic cross sectional view showing a section from the sleeve 8 to the flow divider 15 in an enlarged scale. The flow divider 15 is provided with an engaging projection 19 of substantially truncated cone shape around which the gate sleeve 13 is engaged in such a fashion that the independent stamp side runner 16 is formed between joined surfaces of the gate sleeve 13 and the flow divider 15. A side wall of the engaging projection 19 forms a tapered wall inclined in such a manner as to become narrower toward a stamp wall 20 of the flow divider 15 which faces the sleeve stamp portion 14. Another tapered wall is formed on an inside wall of the gate sleeve 13 so that the engaging projection 19 is engaged to the gate sleeve 13 through joining between the tapered walls.

One end of the stamp side runner 16 reaches the stamp wall 20 of the flow divider 15 and directly faces the sleeve stamp portion 14 so as to introduce a high temperature and good flowable molten metal existing in a center region of the sleeve stamp portion 14 directly into the stamp side runner 16. The other end of the stamp side runner 16 is connected to one end of the die side runner 6 (see FIG. 1) which extends along a parting line between the fixed base 1 and the movable base 3.

Formed on a lower half side of the peripheral wall of the engaging projection 19 of the flow divider 15 is a reservoir 21 of forwardly downward inclined groove shaped concave. An aperture 22 of the reservoir 21 opens on the lower side of the sleeve stamp portion 14. A most recessed portion 23 of dead end shape is located on the outermost side in a radial direction (a lowermost position in the drawing). The radially outermost portion of the most recessed portion 23 wraps a forward end portion of the gate sleeve 13 around and is located in a radially outward direction of a round portion formed on an inner circumferential surface of a forward end wall 13*a* of the gate sleeve 13.

The aperture 22 faces a forward end of a semi-solidified layer 24 of the molten metal 7, so that the semi-solidified layer 24 of the molten metal 7 injected from the sleeve 8 is stored through the aperture 22 in the reservoir 21. The semi-solidified layer 24 is such a layer that a chill and an oxide film are mixed with the molten metal 7. The chill is produced when the molten metal 7 poured from the pouring gate 9 into the sleeve 8 in such a state that the plunger tip 12 is moved back (FIG. 1) is stayed in the lower side of the sleeve 8 and quenched by contacting the wall surface of a low temperature ranging from the bottom wall to the lower half wall of the sleeve 8. At the same time, a surface of the molten metal 7 comes into contact with air thereby to form the oxide film. The semi-solidified layer 24 is produced by this oxide substance and the chill.

The chill and the oxide substance forming the semi-solidified layer 24 are much different in organization and character from a portion formed by the pure molten metal 7. Therefore, in the case where impurities such as the broken chill formed when the chill is broken, the oxide substance, etc. enter the die side runner 6, it becomes a cause that impairs the flowability such as pressure transmission, velocity transmission, etc. As a result, clogging of the gate or the like is developed. In addition, when the impurities enter the cavity 5, the quality may be impaired. In the present invention, however, since the aperture 22 of the reservoir 21 of the flow divider 15 exists just in a place on the stamp wall 20 where the forward end of the semi-solidified layer 24 reaches, a portion on the forward end side of the semi-solidified layer 24 smoothly flows into the reservoir 21 when the molten metal 7 is filled into the sleeve 8 at a predetermined filling factor.

The semi-solidified layer 24 within the sleeve 8 becomes thicker as the temperature of molten metal contacting portion such as the sleeve 8 or the like is lowered. Therefore, it becomes thicker as the distance from the pouring gate 9 increases, that is, as approaching the forward end which is poured at an earlier time. As classified as large, medium or small with quantity in the drawing, the volume of the semi-solidified layer 24 in cross section along the axial direction of the sleeve 8 gradually increases in the forward direction so as to form a continuously varying wedge-shaped layer. In addition, this semi-solidified layer 24 has a substantially semicircular shape viewed in the axial direction of the sleeve 8 (hereinafter, the shape of this semi-solidified layer 24 is referred to as substantially semicircular wedge shape).

The inner wall of the gate sleeve 13 is formed with a tapered wall 13*b* expanded in the forward direction and inclined forwardly downward at the lower portion of the gate sleeve 13. Accordingly, when the poured molten metal 7 reaches the sleeve stamp portion 14, the semi-solidified layer 24 moves along this tapered wall 13*b* thereby to smoothly flow into the reservoir 21. Moreover, since the reservoir 21 itself is inclined forwardly downward in cross sectional view shown in the drawing, the semi-solidified layer 24 is easy to be stored in the most recessed portion 23.

Like this, the semi-solidified layer 24 on the forward end side is stored in the reservoir 21. Therefore, in the state that the molten metal 7 for one shot has flowed into the sleeve 8, the height "H" of the thickest portion on the forward end side of the semi-solidified layer 24 is substantially the same as the height of the aperture 22.

Accordingly, the height H of the thickest portion of the semi-solidified layer 24 is able to be freely adjusted by choosing the size of the aperture 22 of the reservoir 21 and the volume of the reservoir 21. When the filling factor is less than 50%, the surface of the molten metal comes to a lower level than the center axis L1 of the sleeve 8. The center axis of the flow divider 15 corresponds to the central line L1 of the sleeve 8. A reference character L2 in the drawing is a line showing a position of an end 22*a* (see FIG. 4) in the circumferential direction of the aperture 22 which corresponds to the highest position of the aperture 22. There is a slight gap "d" between the line L2 and the center axis L1.

Once the semi-solidified layer 24 is stored in the reservoir 21, a portion of the molten metal 7 in the sleeve stamp portion 14 that is injected into the runner side is separated from the semi-solidified layer 24 so as to be a good flowable molten metal without the semi-solidified layer 24. This good flowable molten metal enters the die side runner 6 via the sleeve stamp portion 14 and the stamp side runner 16 and then is smoothly filled into the cavity 5. For this reason, the molten metal can be filled into the cavity 5 in the good flowable and good running condition, and the impurities are prevented from entering the cavity 5. Then, since the stamp side runner 16 extends directly from the sleeve stamp portion 14, the hotter molten metal 7 is filled into the cavity 5 in large amounts in the condition of lower resistance.

Figure 3:
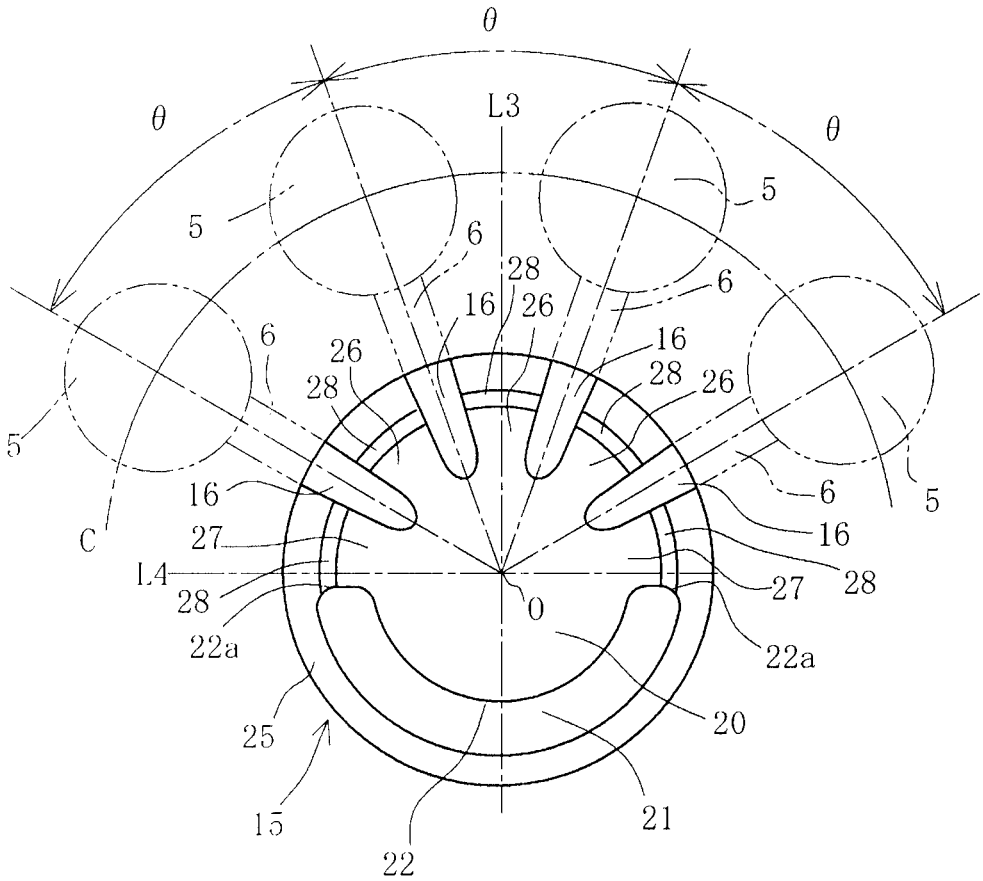
FIG. 3 is a schematic view showing an arrangement of cavities, runners and others.

FIG. 3 is a schematic view of the flow divider 15 taken along line 3-3 of FIG. 2, viewed from the side of the stamp wall 20, wherein an arrangement of the cavity 5 and the die side runner 6 is also shown. A reference character 25 in the drawing denotes an outer circumferential joining portion between the forward end wall 13*a* (see FIG. 2) of the gate sleeve 13 and an outer periphery of the flow divider 15. A reference character 28 denotes a taper joining portion between the flow divider 15 and the tapered wall 13*b* (see FIG. 2) of the gate sleeve 13. This taper joining portion 28 is formed by tapering the lateral wall of the engaging projection 19 with the object of preventing the penetration of the semi-solidified layer and of making the separation of the runner perfect.

As shown in this drawing, the die side runner 6 and the stamp side runner 16 which is continuously connected in a straight line to the die side runner 6 in the state shown in the drawing are formed each with four runners for molding products by four cavities in this embodiment. These runners extend radially from the center "O" of each of the flow divider 15 and the gate sleeve 13 at regular intervals θ and are arranged symmetric with respect to the center line L3 (extending in an upward and downward direction). The line L4 is a horizontal line passing the center "O" and intersecting at right angles with the line L3.

Each of the die side runners 6 has a passage cross section of the same in shape, in length and in size. The die side runners 6 are separated between the fixed base 1 and the movable base 3 and formed independent from each other. At the forward end location of each of the die side runners 6, each of the cavities 5 for the products is arranged on a concentric circle "C" at regular intervals θ.

Further, each of the stamp side runners 16 also has a passage cross section of the same in shape, in length and in size. Each of the stamp side runners 16 forms a straight runner of the same length together with the corresponding die side runner 6. Moreover, the stamp side runners 16 are formed independent from each other and opened separately to the sleeve stamp portion 14, respectively.

Accordingly, the molten metal in the sleeve stamp portion 14 is divided evenly on the step wall 20 and flows into the stamp side runners 16 at the same velocity without mutual interference with the molten metal of the neighboring stamp side runner 16 so that the same amount of the molten metal is supplied simultaneously to each of the cavities 5.

The reservoir 21 is formed on a lower half side of the stamp wall 20 and has the aperture 22 of a substantially semicircular arc shape. This aperture shape corresponds to the shape of the forward end of the semi-solidified layer 24. By the way, the semi-solidified layer 24 is formed in a location contacting the inner wall of the sleeve 8. Therefore, when the filling factor of the molten metal with respect to the sleeve 8 is not more than 50%, the shape of the semi-solidified layer 24 in cross section intersecting the center line L1 of the sleeve 8 (FIG. 2) is a semicircular arc that is substantially the same shape as the aperture 22.

Figure 4:
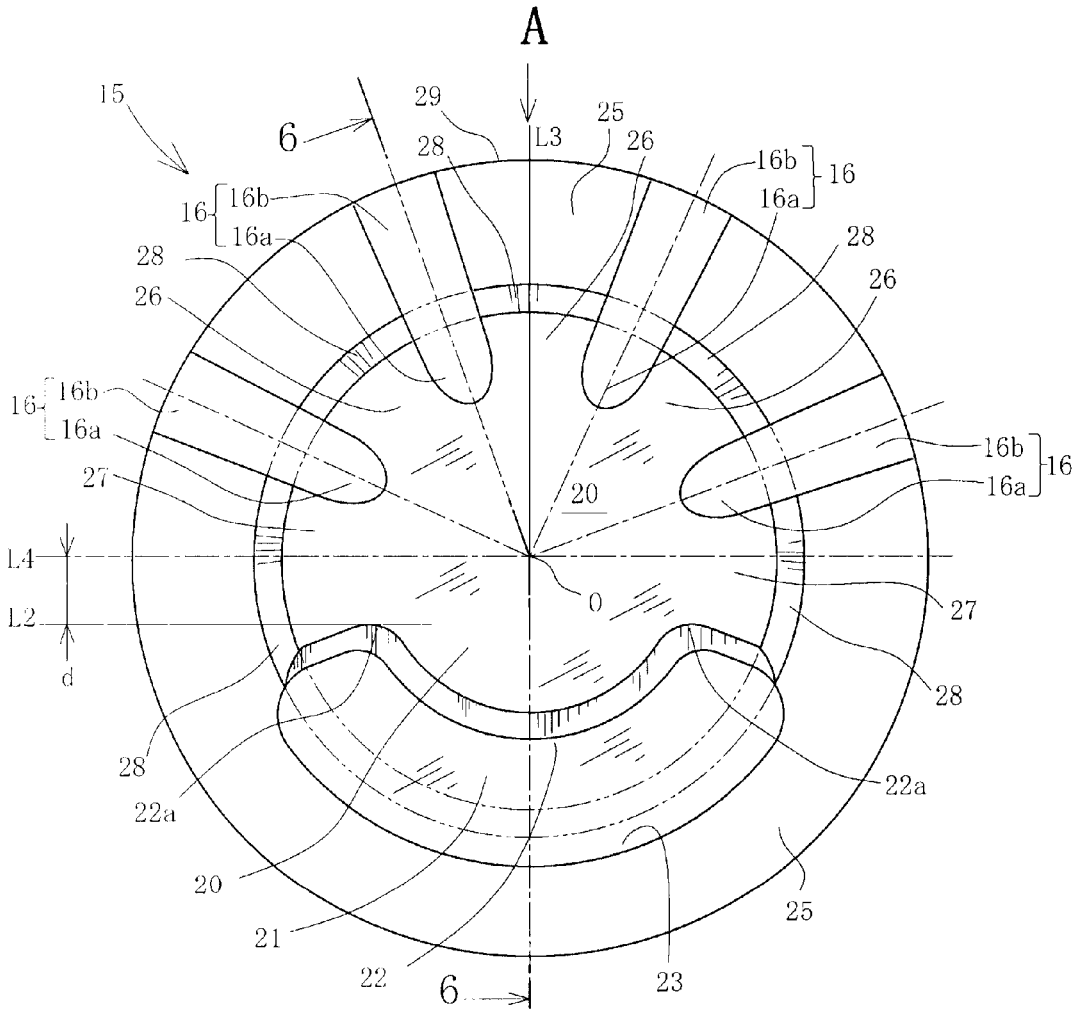
FIG. 4 is a view showing a flow divider from the stamp wall side.
Figure 5:
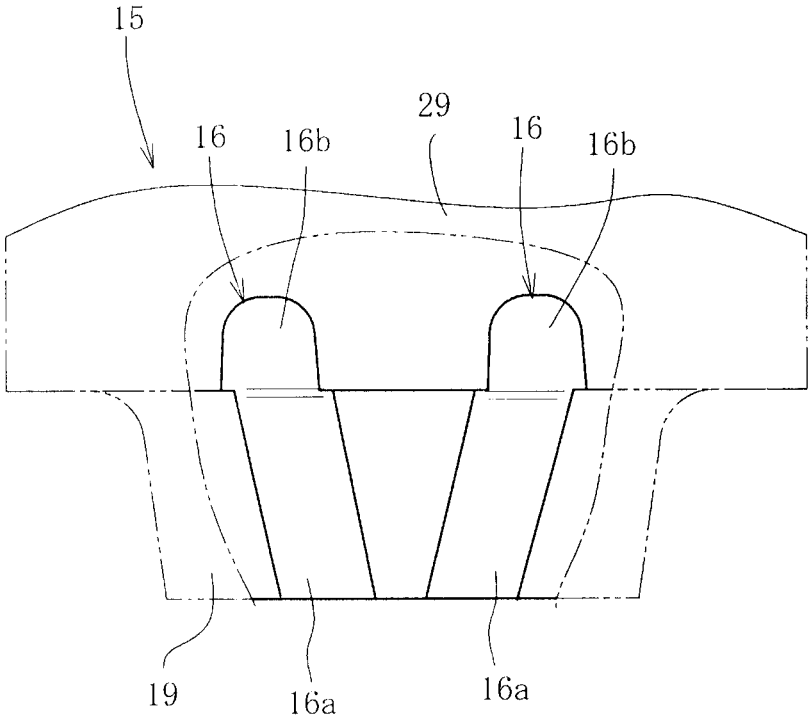
FIG. 5 is a view of the flow divider in a direction of an arrow "A" of FIG. 4.
Figure 6:
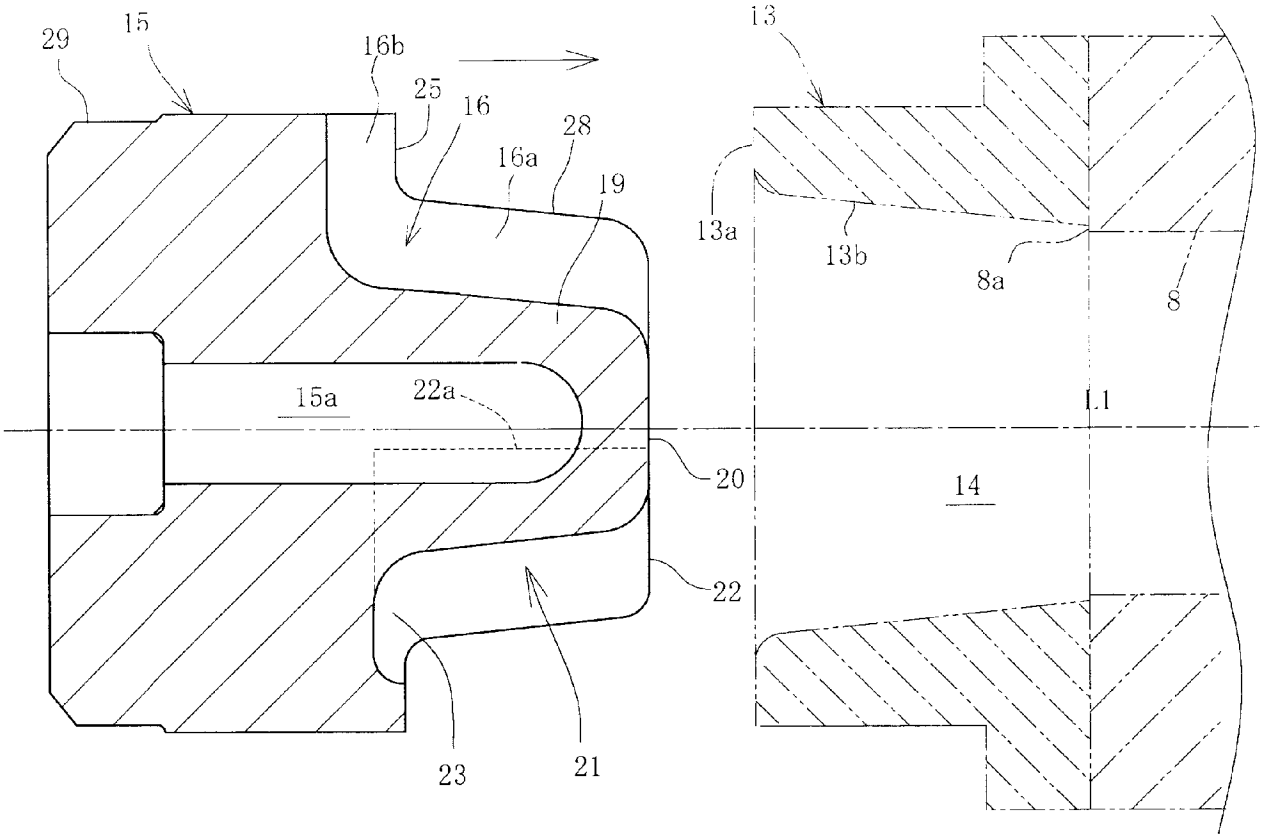
FIG. 6 is a cross sectional view taken along line 6-6 of FIG. 4.

FIG. 4 is a view showing the flow divider 15 in detail from the side of the stamp wall 20. FIG. 5 is a fragmentary view taken in the direction of an arrow A of FIG. 4. FIG. 6 is a cross sectional view taken along line 6-6 of FIG. 4. Referring to these drawings, the flow divider 15 is provided with the engaging projection 19 of small diameter and a base 29 of large diameter (see FIG. 6) so as to form the flat outer circumferential joining portion 25 between the engaging projection 19 and the base 29 each having a concentric circle shape (see FIG. 4 and FIG. 5). As shown in FIG. 6, the stamp side runner 16 has a substantially L-shape in cross section shown in the drawing taken in the direction of the center axis L2 and comprises a horizontal groove 16*a* being slightly inclined and extending in the forward and backward direction and a vertical groove 16*b* extending in the radial direction. An end of the horizontal groove 16*a* on the side of the stamp wall 20 and a connecting portion between the horizontal groove 16*a* and the vertical groove 16*b* are shaped round with the object of reducing flow resistance of the molten metal.

The stamp side runner 16 is formed in the joining portion 28 to the gate sleeve 13, located on the lateral wall of the engaging projection 19 of the flow divider 15. The gate sleeve 13 is provided with the forward end wall 13*a* and the inner circumferential wall. The inner circumferential wall forms the tapered wall 13*b* to be taper-joined to the joining portion 28. The forward end wall 13*a* is fitted to the outer circumferential joining portion 25 which is formed around the engaging projection 19 of the flow divider 15, to cover the vertical groove 16*b* in such a manner as to form one portion of the stamp side runner 16. The tapered wall 13*b* is fitted to the taper-shaped joining portion 28 of the engaging projection 19 of the flow divider 15 to cover the horizontal groove 16*a* in such a manner as to form the other portion of the stamp side runner 16.

The horizontal groove 16*a* is hollowed in the center direction of the flow divider 15 at the joining portion 28 of the engaging projection 19 of the flow divider 15 such that one end of the horizontal groove 16*a* opens on the upper side of the stamp wall 20 to face the sleeve stamp portion 14. The vertical groove 16*b* is hollowed in the direction that the forward end wall 13*a* of the gate sleeve 13 butts against the outer circumferential joining portion 25, such that it is in communication with the horizontal groove 16*a* on the inner side in the radial direction while it is connected to the die side runner 6 on the outer side in the radial direction.

A reference character 8*a* in the drawing denotes a step portion which is formed between the gate sleeve 13 and the forward end of the sleeve 8. The provision of this step portion 8*a* enables the plunger tip 12 to do smooth traveling at the time of injection, even if the dimensional difference is generated due to production error between the gate sleeve 13 and the sleeve 8. A reference character 15*a* denotes a space for cooling.

Referring again to FIG. 4, each of the horizontal grooves 16*a* is formed at the same depth from the outer circumferential side to the center of the stamp wall 20. The forward end of the horizontal groove 16*a* reaches the stamp wall 20 and opens thereto. The outer circumferential portion of the stamp wall 20 is made flush and located between the neighboring stamp side runners 16 and between the stamp side runner 16 and the reservoir 21 thereby to form a seal wall 26 and a seal wall 27. The seal wall 26 and the seal wall 27 are also formed on the outer circumferential joining portion 25.

The seal wall 26 is formed flush with the stamp wall 20 to apply sealing together with the joining portion 28 in such a manner as to make the neighboring stamp side runners 16 independent of each other. Namely, the molten metal 7 introduced into the horizontal groove 16*a* which opens to the stamp wall 20 is separated by the seal wall 26 not to enter the neighboring horizontal groove 16*a*. Further, the forward end wall 13*a* of the gate sleeve 13 comes in sliding contact with the outer circumferential joining portion 25 to apply sealing in such a manner as to prevent the movement of the molten metal between the neighboring vertical grooves 16*b*. Furthermore, the tapered wall 13*b* (see FIG. 6) of the gate sleeve 13 is taper-joined in sliding contact to the joining portion 28 to apply sealing in such manner as to prevent the movement of the molten metal between the horizontal grooves 16*a* extending from the stamp wall 20 to the outer circumferential joining portion 25. Thus, the neighboring stamp side runners 16 are separated by the joining portion 28 and the seal wall 26 through engagement of the gate sleeve 13.

The reservoir 21 is formed from the lower lateral wall of the engaging projection 19 to the forward end joining portion 25 on the lower half side of the stamp wall 20 so as to be spread over the taper joining portion 28 shown in an imaginary line. The height of the circumferential end 22*a* of the aperture 22 is located in the vicinity of the center line L4 (in the horizontal direction) of the flow divider 15, and the gap "d" is extremely small. Although this gap "d" can be freely selected, when it is increased, the size of the seal wall 27 is increased thereby making it possible to ensure sealing against the reservoir 21 more assuredly as referred to later. However, since the circumferential length of the aperture 22 of the reservoir 21 is shortened, the accommodation efficiency of the semi-solidified layer 24 formed in the lower half side in the circumferential direction of the sleeve 8 is decreased. On the contrary, when the gap "d" is decreased, the storage of the semi-solidified layer 24 can be performed more efficiently, but there are cases where it exerts an influence on the multi-cavity molding. Accordingly, the gap "d" is selected by an even balance of both.

The seal wall 27 is formed flush with the stamp wall 20 between each of the right and left circumferential ends 22*a* of the reservoir 21 and the stamp side runner 16 located in the vicinity thereof. This seal wall 27 also separates the stamp side runner 16 from the reservoir 21 located under the stamp side runner 16. An area between the stamp wall 20 of the right and left seal walls 27 and the outer circumferential joining portion 25 is also sealed by the joining portion 28. At the time of engagement of the gate sleeve 13, an area between the reservoir 21 and the stamp side runner 16 neighboring thereto is liquid-tightly sealed by the seal wall 27 and the joining portion 28 such that the semi-solidified layer 24 within the reservoir 21 does not enter the neighboring stamp side runner 16.

Therefore, each of the stamp side runners 16 of the flow divider 15 is separated from the neighboring stamp side runner 16 and the reservoir 21 so that the molten metal introduced into one of the stamp side runners 16 does not flow into another stamp side runner 16. Similarly, the semi-solidified layer 24 introduced into the reservoir 21 does not move and flow into the stamp side runner 16.

Figure 7:
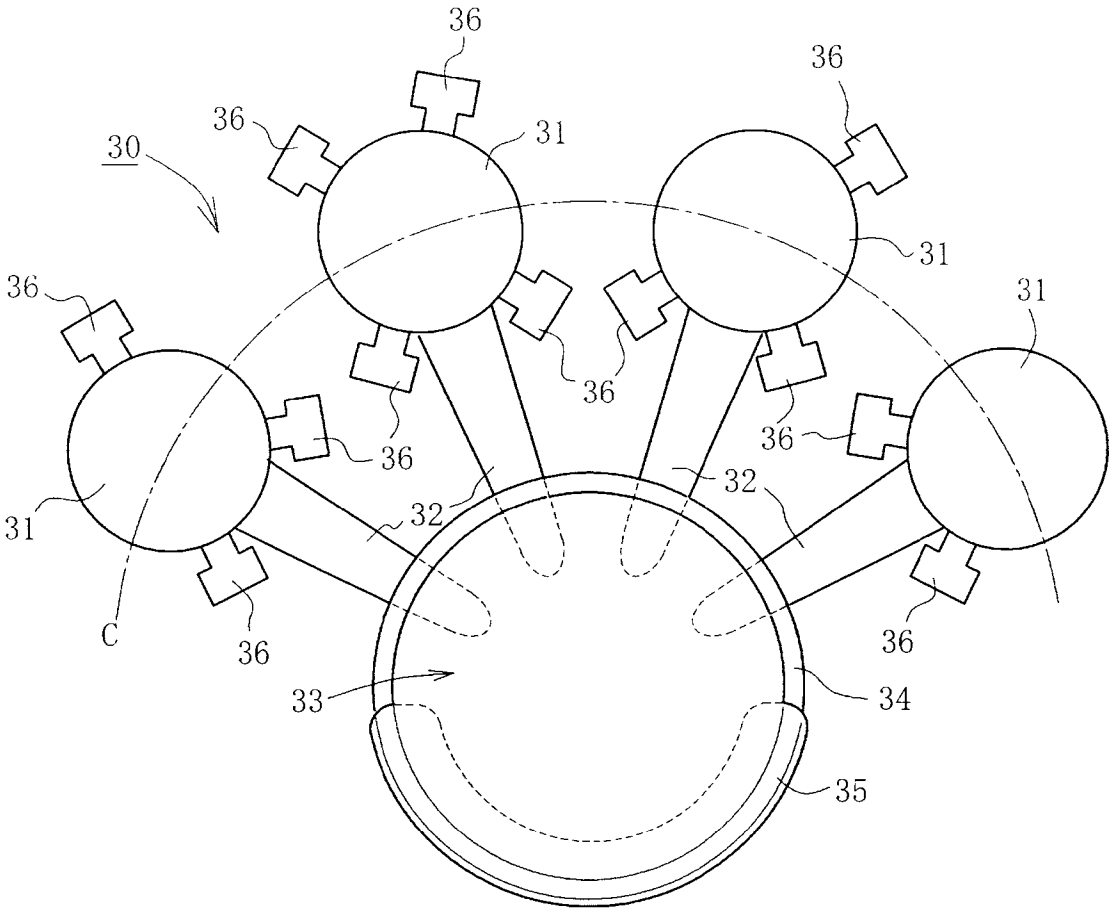
FIG. 7 is a front view of a molded product.
Figure 8:
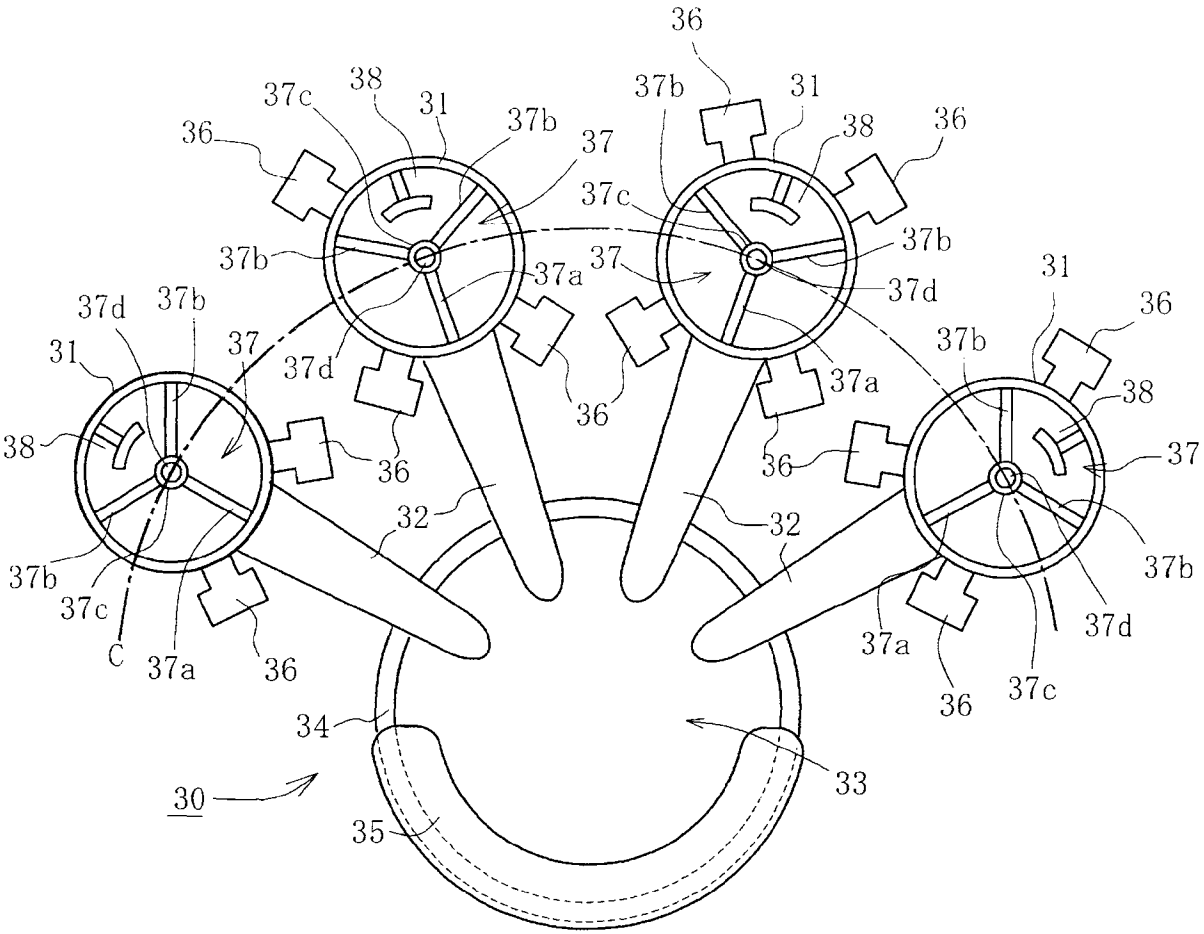
FIG. 8 is a rear view of the molded product.

FIG. 7 is a front view of a mold releasing product 30 attaching a gate stamp portion, a runner portion and an overflow portion thereto just after being cast and released from the die, viewed from the side of the fixed die 2. FIG. 8 is a rear view of the mold releasing product 30, viewed from the side of the movable die 4. As shown in these drawings, the mold releasing product 30 just after being released from the die is so formed that each of product 31 are integrally connected through the runner portion 32 to a biscuit portion 33. The biscuit portion 33 is such a portion that the molten metal of the sleeve stamp portion 14 is solidified. The center of each of the products 31 is located on a circular arc "C" which is concentric with the center of the biscuit portion 33.

The runner portion 32 is so formed that the molten metal of a runner area corresponding to the die side runner 6 and the stamp side runner 16 is solidified. A reference character 34 in the drawing denotes an outer circumferential portion of the biscuit portion 33 which corresponds to the taper joining portion 28 (see FIG. 4). A reference character 35 is a storage solidified portion formed by the reservoir 21. A base of each of the runner portions 32 is connected to the outer circumferential portion 34 of the biscuit portion 33 on the front side and extends close to the center of the biscuit portion 33 across the outer circumferential portion 34 on the rear side.

On the lower half side of the biscuit portion 33 there is formed the substantially semicircular storage solidified portion 35. The storage solidified portion 35 is such a portion that the semi-solidified layer 24 filled into the reservoir 21 is solidified. Each of the runner portions 32 is connected integral with each other through the biscuit portion 33 and also formed integral with the storage solidified portion 35. As apparent from FIG. 8, however, each of the runner portion 32 and the storage solidified portion 35 are separated to be independent, respectively, in the area other than the biscuit portion 33. Through this method, the molten metal can be divided and filled from the sleeve stamp portion of high temperature directly into each of the cavities 5. Further, through the provision of the reservoir 21, it is possible to fill each of the cavities 5 enough with the molten metal without semi-solidified layer.

A reference character 36 denotes the overflow portion formed on an outer peripheral portion of each of the products 31. The overflow portion 36 is formed at the time of gas venting and includes a part of the semi-solidified layer 24 (a part that is not accumulated in the reservoir 21 and that is first filled into the cavity 5). These overflow portions 36 are cut off at the same time when each of the products 31 is separated from the runner portion 32 to be machined.

As shown in FIG. 8, on a back wall (the surface formed by the movable die 4) of each of the products 31, there is provided a substantially Y-shaped rib 37, a leg portion 37*a* of which is located on an extension of the center line of the runner portion 32. When the molten metal flows into the cavity 5 through the die side runner 6 (see FIG. 3), it is evenly separated so as to be penetrated into both sides of the leg portion 37*a*. A joined portion between the leg portion 37*a* and a pair of right and left branched arm portions 37*b* comprises a boss 37*c* along the axial center of which a bore 37*d* for forming a screw bore is formed. A complicate shape portion 38 is provided in an outer area which is put between the arm portions 37*b* in opposition to the leg portion 37*a* across the boss 37*c*. When the molten metal is filled ahead of time from this complicate shape portion 38, the accurate molding can be done.

Figure 9:
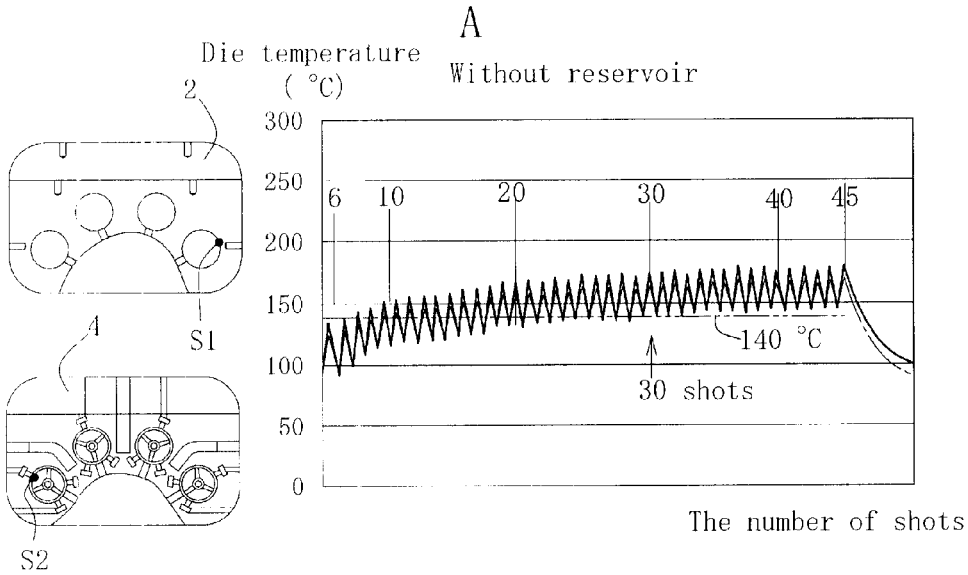
FIGS. 9A and 9B are graphs for comparing a variation in die temperature in proportion to the number of shots.
Figure 9:
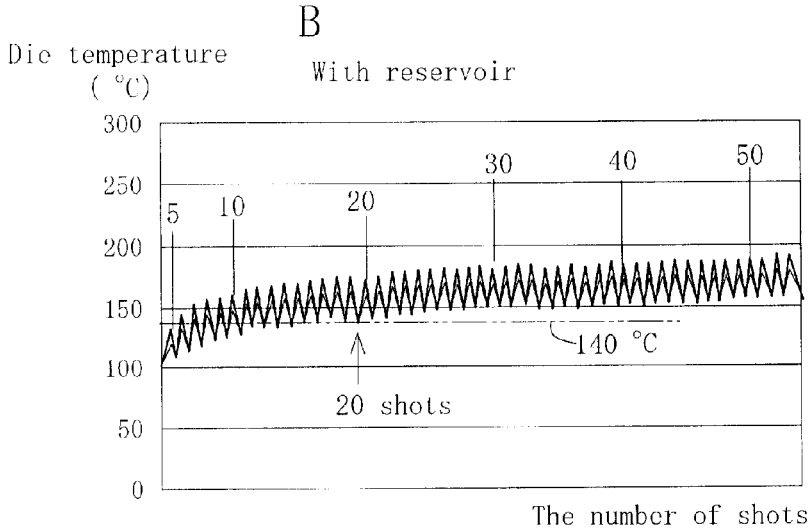

FIGS. 9A and 9B are graphs measuring a variation in die temperature in proportion to the number of shots, wherein with respect to each of a measuring point S1 at which the fixed die 2 reaches the highest temperature and a measuring point S2 at which the movable die 4 reaches the highest temperature. The variation of the die temperature in proportion to the number of shots is shown in the figures. FIG. 9A shows the case where the reservoir 21 is not provided and FIG. 9B shows the case where the reservoir 21 is provided. In either FIGS. 9A or 9B, the die temperatures of the fixed die 2 and the movable die 4 (the die temperatures at the point S1 and the point S2) are substantially the same and correspond with each other to look like a single temperature, while there is a slight temperature difference between these dies. While each of the figures is drawn by a plurality of upward and downward variable waveform lines, each one of the wave-forms shows the variation in die temperature per one each of shots. Therein, a downward projecting acute-angled apex is an initial temperature that is the lowest in die temperature while an upward projecting acute-angled apex is a peak temperature that is the highest in die temperature.

The die temperature necessary for quality stabilization in this mold is not less than 140° C. In the case of FIG. 9A, provided without the reservoir 21, it is about 30shots that the initial temperature reaches this temperature, while in the case of FIG. 9B provided with the reservoir 21, it is about 20 shots. Accordingly, the case of FIG. 9B provided with the reservoir 21 is able to reach the target temperature about 10shots earlier. Therefore, in the case of four-cavity molding production, 40 pieces (4 pieces×10 shots=40 pieces) of defective products (waste spray) may be reduced so that yields can be brought up by the mold construction suitable for multi-cavity production.

Next, the operation of the embodiments of the present invention will be explained. As shown in FIG. 2, when the molten metal 7 is poured from the pouring gate 9 into the sleeve 8, it comes in contact with the bottom area and each lateral area of the inner wall of the sleeve 8 so as to form the quenched chill, and the surface of the molten metal 7 is oxidized to produce the oxide substance. These chill and oxide substance form the semi-solidified layer 24. This semi-solidified layer has a forwardly thickened substantially semicircular wedge shape in cross section taken along the direction of the axial line L1 of the sleeve 8.

However, since the forward end of the semi-solidified layer 24 faces the aperture 22 of the reservoir 21 which is formed on the lower half side of the flow divider 15, it flows into the reservoir 21 to be stored therein, so that it is easily separated so as not to be mixed with the injected molten metal at the time of injection of the molten metal 7. Then, when the plunger 12 is moved forward in such a manner to have the molten metal injected from the sleeve stamp portion 14 to each of the cavities 5 (see FIG. 1), the molten metal 7 in the sleeve stamp portion 14 is divided evenly between the stamp side runners 16 and filled into each of the cavities 5 (FIG. 1).

At this time, the molten metal 7 which is injected from the sleeve stamp portion 14 is separated from the semi-solidified layer 24. Therefore, since the semi-solidified layer 24 is not included or remarkably reduced, the molten metal 7 is in the hot and good flowable condition. Further, each of the stamp side runners 16 separately extends directly from the sleeve stamp portion 14, and each of the neighboring stamp side runners 16 and die side runners 16 is separately sealed through the seal wall 26 and the joining portion 28. Therefore, the molten metal does not move between the neighboring runners, and it is possible to inject the hotter molten metal 7 at a lower resistance. Accordingly, as shown in FIG. 3, the molten metal 7 is rapidly injected from each of the stamp side runners 16 via each of the die side runners 6 to each of the cavities 5 so that each of the cavities 5 is filled with a sufficient amount of molten metal.

Furthermore, each of the cavities 5 is arranged on the concentric circle "C" in the shape of a sector form, viewed from the side of the sleeve 8. Also, each of the die side runners 6 and each of stamp side runners 16 are formed independently with respect to each of the cavities 5 and have the same size and the same length, so that the molten metal 7 reaches each of the cavities 5 simultaneously from each of the die side runners 6 so as to be filled evenly and simultaneously. For this reason, as shown in FIG. 7 and FIG. 8, each of the products 31 can be properly molded by the multi-cavity production method. Moreover, the quality of each of the products 31 can be equalized even in the multi-cavity molding production, thereby making it possible to realize the multi-cavity molding production of good yields.

Further, as shown in FIG. 2, FIG. 4 and FIG. 6, since the reservoir 21 is formed on the lower half side in the periphery of the flow divider 15, the semi-solidified layer 24 which is located on the lower half side of the sleeve 8 such that the forward end thereof faces the reservoir 21 is guided into the reservoir 21 and stored therein. Therefore, even if each of the die side runners 6 is connected to the stamp side runners 16 each of which is open directly to the sleeve stamp portion 14, the molten metal 7 from which the semi-solidified layer 24 is separated is injected into each of the stamp side runners 16, so that this molten metal 7 can be sent to each of the cavities 5 in the condition of high temperature.

Furthermore, since the reservoir 21 is separated from the stamp side runners 16 by the seal wall 27 and the joining portion 28, the penetration of the semi-solidified layer 24 from the reservoir 21 to the stamp side runners 16 can be prevented. Therefore, the molten metal to be injected to the cavities 5 is prevented from being mixed with the impurities such as the broken chill and the oxide substance or the like, so that the quality of each of the products 31 can be stabilized and improved.

Moreover, the semi-solidified layer 24 of comparatively low temperature is isolated by the provision of the reservoir 21 whereby the molten metal to be injected to the cavities 5 can be maintained at an elevated temperature. Therefore, as shown by comparing FIG. 9A and FIG. 9B, the die temperature can be heightened at an early stage. Accordingly, it is possible to improve the working efficiency and to reduce the frequency of the defective casting by diminishing the waste spray. As a result, it is possible to bring the yields up in the multi-cavity mold and to improve the mass productivity.

Furthermore, the heat insulating grooves 17 are provided in the fixed die 2 which has a tendency to being low in die temperature, so as to prevent lowering of the die temperature, while the cooling bores 18 are provided in the movable die 4 which has a tendency to being high in die temperature, so as to be used for heat radiation in order for facilitating the cooling, so that the die temperatures of the fixed die 2 and the movable die 4 can be made uniform and the quality of the products 31 can be stabilized.

What is claimed is:

1. A multi-cavity mold in which a molten metal is filled from a sleeve for a plurality of products, the multi-cavity mold comprising:

a plurality of preformed cavities being arranged in a shape of a sector form on a concentric circle when viewed in an axial direction of the sleeve;

a plurality of runners being connected to each of the cavities to supply the molten metal simultaneously to each of the cavities, wherein the runners are arranged separate from each other and extend radially from a sleeve stamp portion, and an end of each of the runners is arranged to directly face the sleeve stamp portion;

a gate sleeve being connected to an end of the sleeve; and a flow divider being engaged with an inside of the gate sleeve while leaving a clearance around a periphery thereof, wherein the clearance between the periphery of the flow divider and the gate sleeve is divided in a circumferential direction of the flow divider so as to form the plurality of runners, wherein the runners are provided in an upper half region of the clearance formed between the periphery of the flow divider and the gate sleeve while a groove shaped reservoir is provided only in a lower half region of the clearance such that a semi-solidified layer formed within the sleeve is stored in the reservoir, the gate sleeve comprises a concave portion and the flow divider comprises a base and a projection portion, the projection portion of the flow divider being engaged with the concave portion of the gate sleeve, the projection portion of the flow divider having a plurality of depressed grooves in an upper half region of the projection portion and an only single depressed groove in a lower half region of the projection portion, the plurality of depressed grooves in the upper half region of the projection portion forming the plurality of runners that are separated from each other by a seal wall formed by the inner circumference of the concave portion of the gate sleeve and the projection portion of the flow divider and the single depressed groove in the lower half region of the projection portion forming the groove shaped reservoir that is separated from the plurality of runners by a seal wall formed by the inner circumference of the concave portion of the gate sleeve and the projection portion of the flow divider when the projection portion of the flow divider is engaged with the concave portion of the gate sleeve, the groove shaped reservoir being formed between the projection portion of the flow divider and the inner circumference of the concave portion of the gate sleeve, and the surface of the projection portion of the flow divider is in contact with the surface of the concave portion of the gate sleeve to separate the plurality of runners and the reservoir from each other, wherein each of the plurality of the cavities has a Y-shaped rib, one leg of the Y-shaped rib extending parallel to the direction of extension of the runner radially from the sleeve stamp portion.

2. The multi-cavity mold of claim 1, further comprising:

a fixed die being connected to the gate sleeve, the fixed die having a plurality of adiabatic grooves above the gate sleeve; and a movable die being connected to the flow divider, the movable die having a plurality of cooling bores above the flow divider.

3. The multi-cavity mold of claim 1, wherein the groove shaped reservoir is surrounded by the projection portion of the flow divider and the gate sleeve.

4. The multi-cavity mold of claim 1, wherein the depressed grooves in the upper half region of the projection portion of the flow divider have a substantially L-shape in a cross section in a direction of an axis of the projection portion.

5. The multi-cavity mold of claim 4, wherein the substantially L-shaped depressed groove comprises a depressed groove extending in the direction of the axis of the projection portion and a depressed groove extending in a radial direction of the base of the flow divider.

6. The multi-cavity mold of claim 1, wherein the multi-cavity mold further comprises a step portion between the gate sleeve and the end of the sleeve and inside the gate sleeve and the sleeve.

7. The multi-cavity mold of claim 1, wherein the groove shaped reservoir is surrounded by the projection portion of the flow divider and the inner circumference of the concave portion of the gate sleeve.

8. The multi-cavity mold of claim 1, wherein each of the plurality of the cavities has a boss at a joined portion between the leg portion and a pair of right and left arm portions of the Y-shaped rib.

* * * * *